United States Patent [19]

Campbell et al.

[11] 4,173,373

[45] Nov. 6, 1979

[54] ADVANCE METHOD AND APPARATUS FOR MINING

[75] Inventors: John A. L. Campbell, Mascoutah; Daniel J. Moynihan, Belleville, both of Ill.

[73] Assignee: Peabody Coal Company, Inc., St. Louis, Mo.

[21] Appl. No.: 827,575

[22] Filed: Aug. 25, 1977

[51] Int. Cl.[2] ..... E21D 20/00

[52] U.S. Cl. ..... 299/11; 299/18

[58] Field of Search ..... 299/11, 12, 18; 198/312, 314, 315, 316

[56] References Cited

U.S. PATENT DOCUMENTS

| | | | |
|---|---|---|---|
| 2,796,199 | 6/1957 | Russell | 198/314 |
| 3,268,258 | 8/1966 | Kegel | 299/18 |
| 3,402,805 | 9/1968 | Spellman, Jr. | 198/316 |
| 3,792,568 | 2/1974 | Gurdlach | 299/12 |
| 3,826,353 | 7/1974 | Greasley | 198/314 |
| 3,920,115 | 11/1975 | Craggs | 198/862 |
| 3,939,958 | 2/1976 | Pyles | 299/11 |
| 3,995,905 | 12/1976 | Jamison | 299/11 |

*Primary Examiner*—William Pate, III

*Attorney, Agent, or Firm*—Littlepage, Quaintance, Murphy, Richardson and Webner

[57] ABSTRACT

A mine roof-bolter machine having an extensible conveyor running therethrough operates behind a continuous miner machine. As the continuous miner advances, the roof-bolter advances from position-to-position while installing roof bolts and plates, and the extensible conveyor gives and takes the slack between the continuous miner and the roof bolter and feeds mined material to a surge car behind the roof bolter.

5 Claims, 5 Drawing Figures

ADVANCE METHOD AND APPARATUS FOR MINING

RELATED APPLICATIONS

A Campbell and Moynihan MINING METHOD AND APPARATUS, Ser. No. 678,680 filed Apr. 20, 1976 now U.S. Pat. No. 4,104,550; and Campbell and Moynihan MINING APPARATUS AND METHOD, Ser. No. 698,885 filed June 31, 1976 now U.S. Pat. No. 4,082,360.

FIELD OF INVENTION

Mining Or In Situ Disintegration Of Hard Material, Rotary cutter head with advance direction coinciding with rotary axis, with material handling means.

BACKGROUND

Heretofore, it has been not unusual for a portable conveyor system to run between a continuous mining machine and a fixed terminus of a main conveyor system which transports coal to the earth's surface. In some instances, there are extensible floor-supported belt systems, such as disclosed in the patent to Moon U.S. Pat. No. 2,986,266, and in other instances they are roof-supported monorail systems, such as shown in Craggs U.S. Pat. No. 3,920,115. In room-and-pillar coal mining, a major problem results from the prohibition against working beneath an un-bolted or unsupported roof.

Assuming that a continuous mining machine makes two side-by-side ten foot wide cuts, and assuming further that a portable extensible conveyor is connected either directly behind the miner or to a surge car; usually the continuous miner, after cutting in about eighteen feet, must back out of the cut and move to another location while the roof bolter operates, and then moved back to resume the cut. This entails re-arrangements of the conveyor and discontinuous face-haulage.

OBJECTS

The primary object of this invention is to provide a method and apparatus for advance, room and pillar mining with continuous advance of the miner, continuous face haulage, continuous ventilating, and means for continuous roof control behind the miner. To this end it is intended now to provide a roof bolting machine, preferably with two booms in front and one behind, an extensible conveyor carried by the roof bolting machine and running from a continuous miner and through the roof-bolting machine to a surge car or other coal receiving apparatus behind the roof bolting machine. If the system is to be used in conjunction with a Craggs (supra) type monorail conveyor system, it is preferred also that the roof-bolting machine have an additional boom on its rear for installing an advancing terminus for the monorail in the mine roof preferably the bolting machine would be used with blowing face ventilation and a high efficiency scrubber. By these means, it is possible for the mining machine to make box and slab cuts while the roof bolting machine stops from time-to-time to drill, bolt and install roof bolts behind it.

These and other objects will be apparent from the following specifications and drawings, in which.

THE SYSTEM

Figure 1:
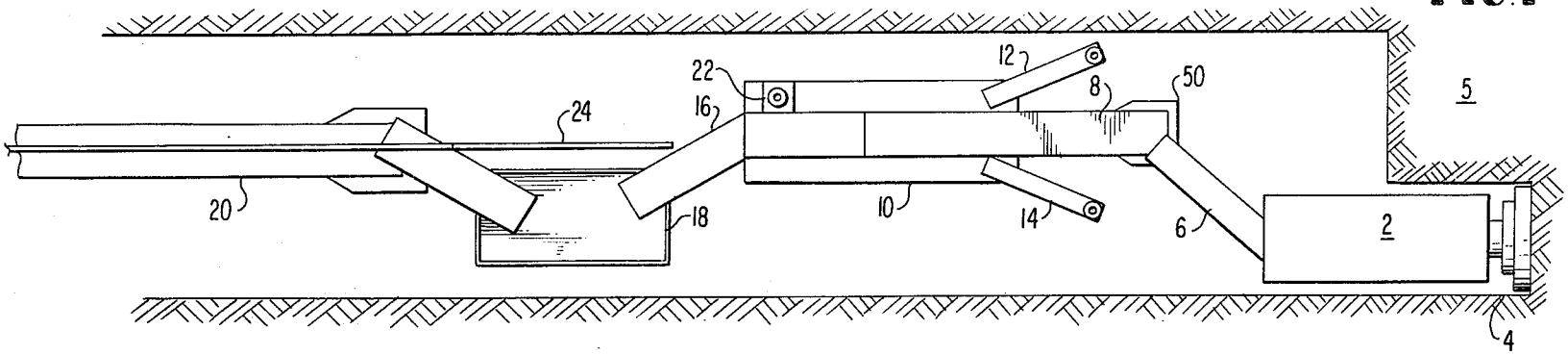
FIG. 1 is a diagrammatic plan view illustrating the over-all system and method.
Figure 4:
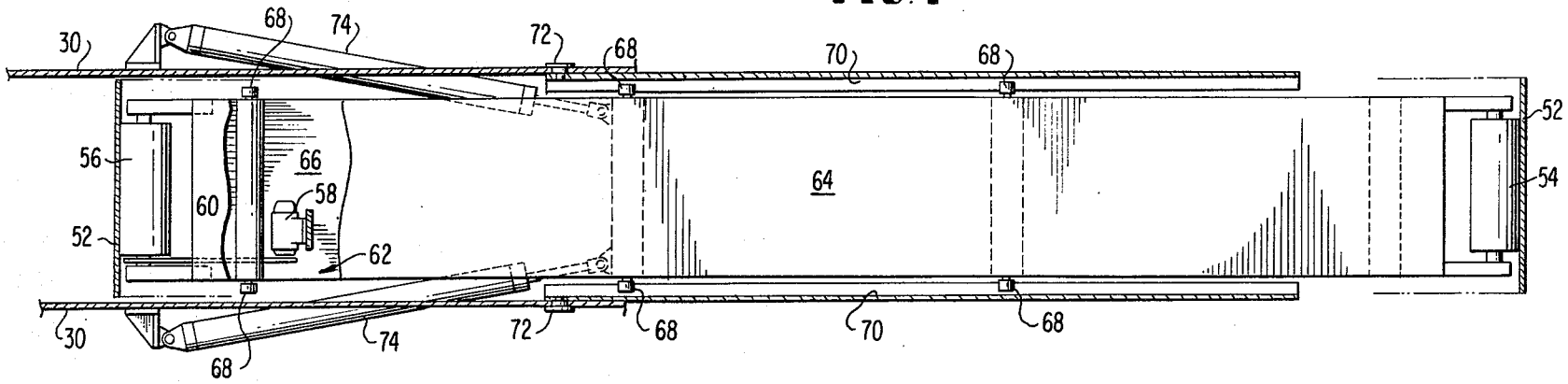
FIG. 4 is a plan view of the supporting plate and extending mechanism for the extensible portion of the endless conveyor; and, FIG. 5 is a side elevation of the structure shown in FIG. 4.
Figure 5:
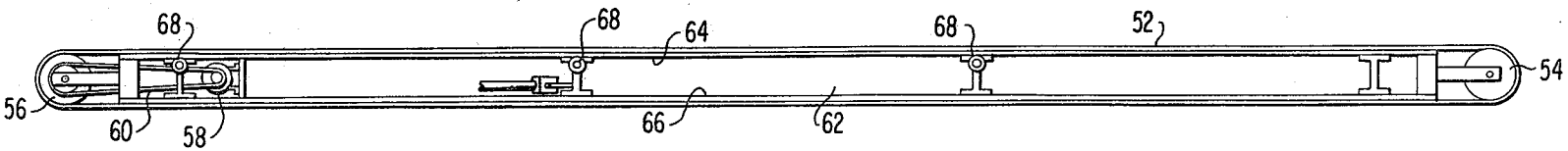
Figure 2:
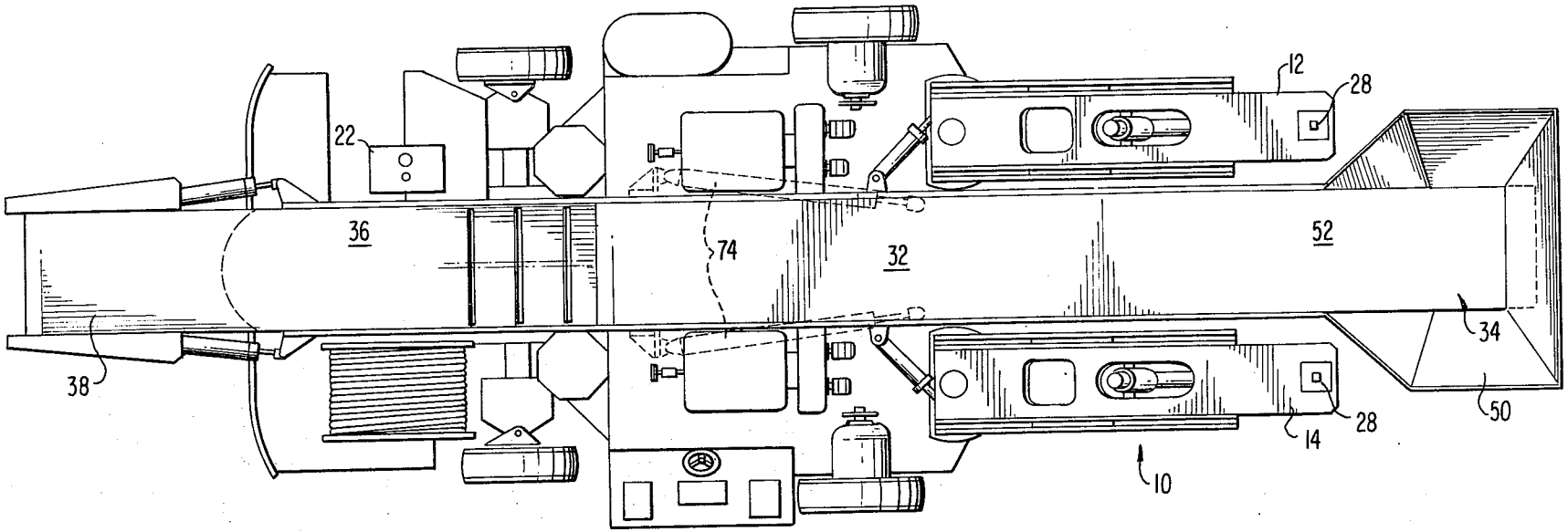
FIG. 2 is a plan view of the mine roof drilling and bolting machine and extensible conveyor.
Figure 3:
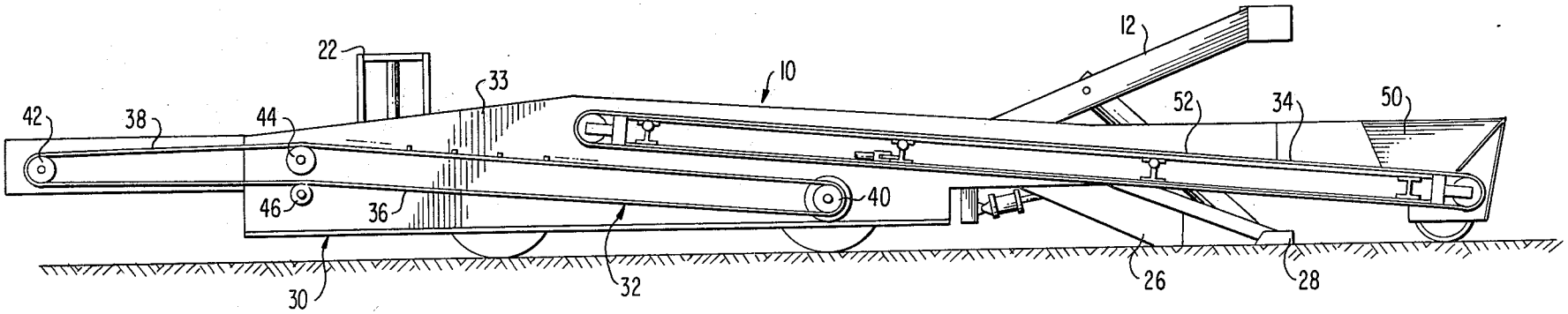
FIG. 3 is a side elevation of the mine roof drilling and bolting machine shown in FIG. 2.

FIG. 1 diagrammatically illustrates the system in typical operating mode, wherein a continuous miner 2 is making a cut 4 in a coal panel 5. An output conveyor 6 on the rear of the continuous miner discharges coal onto the forward end of an extensible endless belt conveyor 8 which runs through a roof bolting machine 10 which, for the moment, will assumed to be stationary while its two forward booms 12 and 14 are being utilized to drill, plate and bolt the roof behind the continuous miner. A laterally swingable output end boom 16 for the extensible endless belt conveyor 8 discharges coal into a surge car 18, from which coal is discharged onto the forward end of an endless conveyor 20, preferably of the Craggs type which is supported from the mine roof by a monorail. While the forward booms of the roof bolting machine are being utilized to drill, plate and bolt the mine roof, a rear boom 22 on the roof bolter may be used to install advancing monorail sections 24 so that the forward terminous of the Craggs conveyor can follow along behind the surge car.

THE ROOF DRILLING AND BOLTING MACHINE AND EXTENSIBLE CONVEYOR

The features of the roof drilling and bolting machine 10 which are peculiar to this invention are shown in FIGS. 2 through 5. In general, the booms 12 and 14, feet 26, drill boxes 28, propelling motors for the wheels, and driving mechanism for the front booms are of the type well known in the industry, for example, as in model RBT-137 manufactured by Lee Norse Company, and, if desired, a third conventional roof drilling assumbly may be mounted on the rear by a suitable mounting 22 as partly illustrated in the drawings. The various motors pumps, controls, etc. for these machines, although diagrammatically illustrated, are so well known as to need no detailed textual description. The distinguishing feature of this machine is that a chassis 30 is provided with a conveyor 32 running in a channel therethrough from front to rear. One side of the channel is indicated at 33 in FIG. 3. In this example, the conveyor is formed of front and rear sections 34 and 36, the front section 34 being extensible and the rear section 36 having a laterally-swingable output end 38 so that the coal carried by the belt can be discharged either directly behind, or behind and to the right, or behind and to the left of the roof bolting machine.

The rear section 36 of the extensible belt system runs over end rollers 40 and 42 and intermediate rollers 44, 46, one or more of which are driven by a suitable motor, not shown, and the output end is manipulatable laterally by suitable conventional mechanism, not shown.

The front section 34 of the endless belt discharges out the rear section. The forward end of the front section is supported by wheels 49, and a hopper 50 receives the coal from the output conveyor 6 on the mining machine and feeds it onto the endless belt 52. The endless belt 52 runs over end rollers 54, 56, the latter of which is driven by a hydraulic motor 58 via a chain 60. An extensible belt chassis 62 having upper and lower plates 64, 66 is supported by three sets of rollers 68 on each side of which roll in channels 70, one on each side of the channel 33, the rear ends of the channels being supported on the main machine chassis 30 by pivots 72. Suitable conventional means, like compression springs (not shown) should be used for maintaining belt 52 taut, and hydraulic rams 74 connected between the main machine chassis 30 and the extensible belt chassis 62 move the latter forwardly and rearwardly as needed to give and take slack between the mining machine 2 and the roof drilling and bolting machine 10.

In operating, let it be assumed that the roof drilling and bolting machine 10 is momentarily stationary, and engaged in installing roof control apparatus, such as plates, with its front booms, and suspending a monorail section from the mine roof with the drilling mechanism (not shown) supported as at 22. As the mining machine advances, the front conveyor section 34 is correspondingly advanced by rams 74 so as to keep hopper 50 in position to receive coal from the output conveyor 6 of the mining machine, which coal is discharged from the output end 16 of the rear conveyor section 36 into a surge car or other receiving device. When the roof bolting machine is ready to move forwardly to install the next roof control mechanism, its drive mechanism is actuated to move it forwardly while rams 74 are shortened so as to retract the forward belt section 34 sufficiently to maintain hopper 50 in position to receive coal from the mining machine.

I claim:

1. A method of underground mining, comprising continuously mining an entry through material mined by forwardly moving a mining machine into said material, applying roof control means to the entry behind the mining machine by forwardly moving a roof drilling and bolting machine from position-to-position independently of the forward movement of the mining machine, and continuously transporting the material mined by the mining machine by a conveyor running through the roof drilling and bolting machine to a material receiving device behind the roof drilling and bolting machine wherein the conveyor moves extensibly with respect to the mine roof drilling and bolting machine to compensate for difference in advance between the mining machine and the mine roof drilling and bolting machine resulting from the independent movements thereof.

2. The method claimed in claim 1, and the step of utilizing the mine roof drilling and bolting machine for installing monorail sections while the mine roof drilling and bolting machine is stopped at successive positions.

3. The method claimed in claim 1, wherein the mining system is operated with a blowing face ventilation system.

4. The method claimed in claim 1, wherein the mining system is utilized with a high efficiency respirable dust scrubber system.

5. The method claimed in claim 3, wherein the blowing face ventilation system is supported and advanced by a monorail roof-mounted Serpentix System characterized by a flexible-frame endless conveyor supported on a roof-supported monorail.

* * * * *